US011353177B1

(12) United States Patent
Jia et al.

(10) Patent No.: US 11,353,177 B1
(45) Date of Patent: Jun. 7, 2022

(54) SMART CURTAIN LIGHT STRINGS

(71) Applicant: SHENZHEN EKOLA LIGHTING TECHNOLOGY CO., LTD., Shenzhen (CN)

(72) Inventors: Bingbin Jia, Shenzhen (CN); Jianbo Chen, Shenzhen (CN); Dingbo Xie, Shenzhen (CN); Jie Liu, Shenzhen (CN)

(73) Assignee: SHENZHEN EKOLA LIGHTING TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/340,068

(22) Filed: Jun. 6, 2021

Related U.S. Application Data

(63) Continuation of application No. PCT/CN2021/087883, filed on Apr. 16, 2021.

(51) Int. Cl.

| | |
|---|---|
| ***F21S 4/15*** | (2016.01) |
| ***E06B 9/36*** | (2006.01) |
| ***F21V 33/00*** | (2006.01) |
| ***F21V 23/00*** | (2015.01) |
| *F21Y 115/10* | (2016.01) |
| *E06B 9/24* | (2006.01) |

(52) U.S. Cl.
CPC ..... *F21S 4/15* (2016.01); *E06B 9/367* (2013.01); *F21V 23/003* (2013.01); *F21V 33/0016* (2013.01); *E06B 2009/247* (2013.01); *F21Y 2115/10* (2016.08)

(58) Field of Classification Search
CPC ..... F21S 4/15; F21S 4/00; F21S 4/10; E06B 9/367; E06B 2009/247; E06B 9/24; F21V 23/003; F21V 33/0016; F21V 23/00; F21V 33/00; F21V 33/0012; F21V 33/0004; F21Y 2115/10
See application file for complete search history.

(56) References Cited

U.S. PATENT DOCUMENTS 4,965,701 A * 10/1990 Voland ..... F21V 5/06 362/249.14
5,893,634 A * 4/1999 Wang ..... F21V 21/08 362/396
5,915,827 A * 6/1999 Wang ..... F21S 4/10 362/396
8,104,917 B2 * 1/2012 Link ..... H05B 47/155 345/82

(Continued)

*Primary Examiner* — Bao Q Truong

(57) ABSTRACT

The present disclosure provides smart curtain light strings including a fixing unit, a mounting unit, a light-emitting unit, and a control unit. The fixing unit passes through and is engaged with the mounting unit. The fixing unit includes a first guiding rail and a second guiding rail. Fixing pieces are fixedly connected with a top portion of the second guiding rail by screws. A horizontal plate is fixedly connected to a side of each fixing piece. Fixing plates are mounted on two sides of the first guiding rail. Positioning pieces are threadedly connected to the top portion of the second guiding rail. The mounting unit includes clamping sleeves and clump weights. A stabilizing sleeve passes through an interior of each clamping sleeve. Each stabilizing sleeve is screwed with each clamping sleeve through threads. A package cap is connected to a bottom portion of each stabilizing sleeve through threads.

9 Claims, 8 Drawing Sheets

(56) References Cited

U.S. PATENT DOCUMENTS

2002/0105803 A1* 8/2002 Deutsch ..... F21V 33/0016
362/370
2020/0332594 A1* 10/2020 On ..... H02K 7/116

* cited by examiner

SMART CURTAIN LIGHT STRINGS

TECHNICAL FIELD

The present disclosure relates to a field of smart lamp technology, and in particular to smart curtain light strings.

BACKGROUND

Smart lamp beads refer to lamp beads that realize remote centralized control and management of lamp beads by applying advanced, efficient and reliable power line carrier communication technology and wireless GPRS/CDMA communication technology, etc.

Smart lamp beads are an important part of smart city. It applies urban sensors, power line carriers/ZigBee communication technology and wireless GPRS/CDMA communication technology, etc., to connect the lamp beads in the city to form the Internet of Things, and realize remote centralized control of lamp beads. Light strings formed in series by electrical wires, are more suitable for decoration and brightization of outdoor park, outdoor lawn, outdoor trees, indoor entertainment venues, and home.

However, areas covered by the lamp beads are limited and scattered, which is not conducive to forming a decorative effect of a sheet-shaped lamp curtain, so that uses of the lamp beads are limited. For above reasons, it is necessary to provide a smart curtain light strings.

SUMMARY

To overcome shortcomings in the prior art, the present disclosure provides smart curtain light strings. By providing multiple electrical wires that arranged in equal intervals, a curtain type electrical wire array is formed. Meanwhile, an outer surface of each electrical wire is electrically connected to multiple LED lamp beads, so that curtain-like light strings are formed, which increases a decorative area compared with conventional light strings, thereby improving scalability of the curtain light strings.

In order to solve the above problems in the prior art, the present disclosure provides following technical solutions. The present disclosure provides smart curtain light strings. The smart curtain light strings comprises a fixing unit, a mounting unit, a light-emitting unit, and a control unit. The fixing unit passes through the mounting unit. The fixing unit is engaged with the mounting unit.

The fixing unit comprises a first guiding rail and a second guiding rail. Fixing pieces are fixedly connected with a top portion of the second guiding rail by screws. A horizontal plate is fixedly connected to a side of each fixing piece. Fixing plates are mounted on two sides of the first guiding rail. Positioning pieces are threadedly connected to the top portion of the second guiding rail.

The mounting unit comprises clamping sleeves and clump weights. A stabilizing sleeve passes through an interior of each clamping sleeve. Each stabilizing sleeve is screwed with each clamping sleeve through threads on an inner surface of each clamping sleeve. A package cap is connected to a bottom portion of each stabilizing sleeve through threads. A groove is disposed on a surface of each clump weight. A connecting hole is on each groove. A hanging ring passes through an interior of each connecting hole.

The light-emitting unit comprises electrical wires and LED lamp beads. Outer surfaces of the electrical wires are electrically connected to the LED lamp beads. A first protective shell and a second protective shell are mounted on an outer surface of each LED lamp bead. Each first protective shell is glued and connected with a corresponding second protective shell.

The control unit comprises a lamp bead circuit, a digital control chip, and a switch. The digital control chip is an STM32F030F4P6 ARM microprocessor. A signal transmission end of the STM32F030F4P6 ARM microprocessor and a signal input end of the switch are connected with each other. A power signal input end of the STM32F030F4P6 ARM microprocessor is connected with a high level. A ground terminal of the STM32F030F4P6 ARM microprocessor is connected with a low level.

In one optional embodiment, a limit groove is formed between the first guiding rail and the second guiding rail. Each fixing piece is arranged in an L shape. A bottom portion of each fixing piece fully contacts a top surface of the first guiding rail. A fixing hole is on one side of each fixing piece. An opening of each fixing hole is oblong.

In one optional embodiment, the fixing plates are respectively mounted on both ends of the first guiding rail. One side of each fixing plate is threadedly connected with two locking pieces.

In one optional embodiment, one end of each horizontal plate is connected with a respective integration block. A threaded locking rod is disposed in the integration block. A bottom portion of each integration block matches and clamps with the second guiding rail.

In one optional embodiment, a gasket is sleeved on a surface of each positioning piece. A circular groove is disposed on a top portion of the positioning piece, and each gasket is a hexagonal metal sheet.

In one optional embodiment, an anti-skid ring is disposed on an outer surface of each stabilizing sleeve. Each anti-skid ring is an annular protrusion, Each clamping sleeve is arranged concentrically with a corresponding stabilizing sleeve and a corresponding package cap. Each clump weight is a drop-shaped clump weight.

In one optional embodiment, a bottom portion of each electrical wire is movably connected with a corresponding clump weight via a corresponding hanging ring. The electrical wires are linearly arranged at equal intervals. An outer surface of each electrical wire are fixedly connected with a plurality of the LED lamp beads.

In one optional embodiment, the high level ranges from 3.5-5V, and the low level ranges from 0-0.25V.

In one optional embodiment, the lamp bead circuit comprises a component supply voltage, a device supply voltage, and a peak-to-peak voltage. The component supply voltage supplies power to the lamp beads. The device supply voltage supplies power to the digital control chip. The peak-to-peak voltage is configured to write code and burn the codes.

Compared with the prior art, by providing the multiple electrical wires that linearly arranged in equal intervals, the curtain type electrical wire array is formed. Meanwhile, the outer surface of each electrical wire is electrically connected to the multiple LED lamp beads, so that curtain-like light strings are formed, which increases the decorative area compared with conventional light strings, thereby improving scalability of the smart curtain light strings.

In the present disclosure, each hanging ring is movably connected with the corresponding clump weight, so that one end of each electrical wire is connected with the corresponding clump weight. Thus, the electrical wires with the lamp beads form a sagging style, thereby facilitating an installation of the smart curtain light strings and improving a decorative effect of the smart curtain light strings In the present disclosure, the glue is filled in the first protective shells and the second protective shells, which greatly enhances a waterproof ability of the LED lamp beads. Thus, the smart curtain light strings are suitable for installation and use in outdoor lawns or parks, thereby improving occasional adaptability of the smart curtain light strings.

1—fixing unit; 11—first guiding rail; 12—second guiding rail; 13—fixing piece; 14—fixing hole; 15—horizontal plate; 16—fixing plate; 17—locking member; 18—integration block; 19—positioning piece; 191—gasket; 2—mounting unit; 21—clamping sleeve; 22—stabilizing sleeve; 23—anti-skid ring; 24—package cap; 25—hanging ring; 26—clump weight; 261—groove 3—light-emitting unit; 31—electrical wire; 32—first protective shell; 33—second protective shell; 34—LED light bead; 4—control unit.

DETAILED DESCRIPTION

In order to make technical means, creative features, objectives and effects of the present disclosure easy to understand, the following further describes the present disclosure in conjunction with specific embodiments, but the following embodiments are only optional embodiments of the present disclosure, not all of them. Based on the embodiments in the implementation manners, other examples Obtained by those skilled in the art without creative work shall fall within the protection scope of the present disclosure. Experimental methods in the following examples are conventional methods unless otherwise specified. The materials and reagents used in the following examples can be obtained from commercial sources unless otherwise specified.

Embodiment

Figure 1:
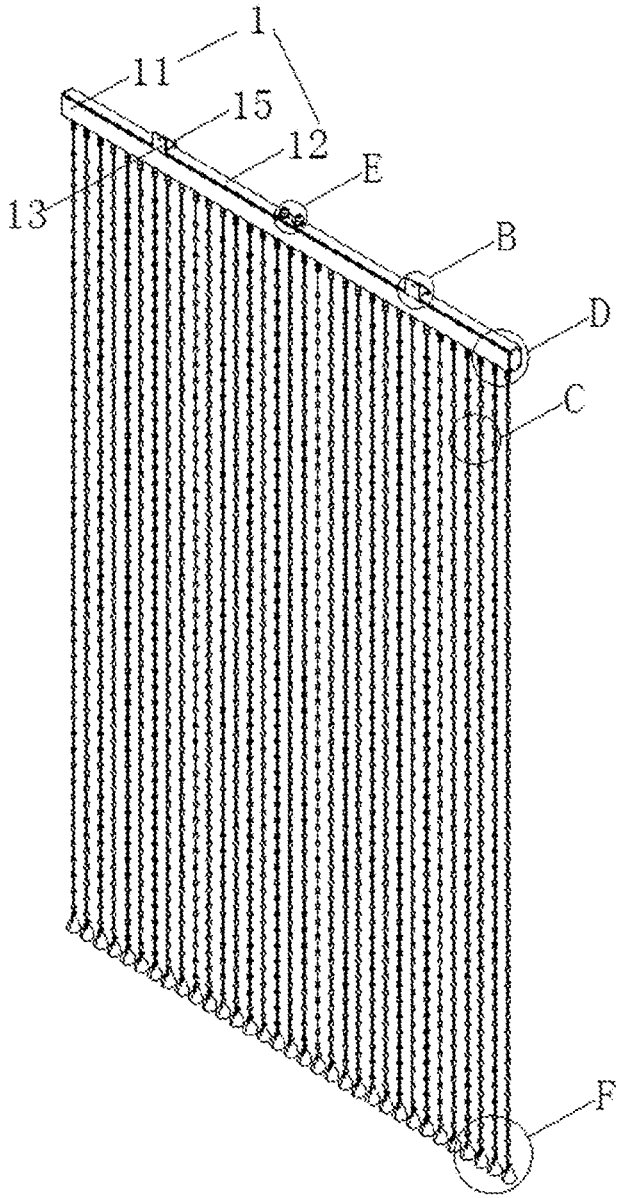
FIG. 1 is a schematic diagram showing an overall structure of smart curtain light strings of the present disclosure.
Figure 2:
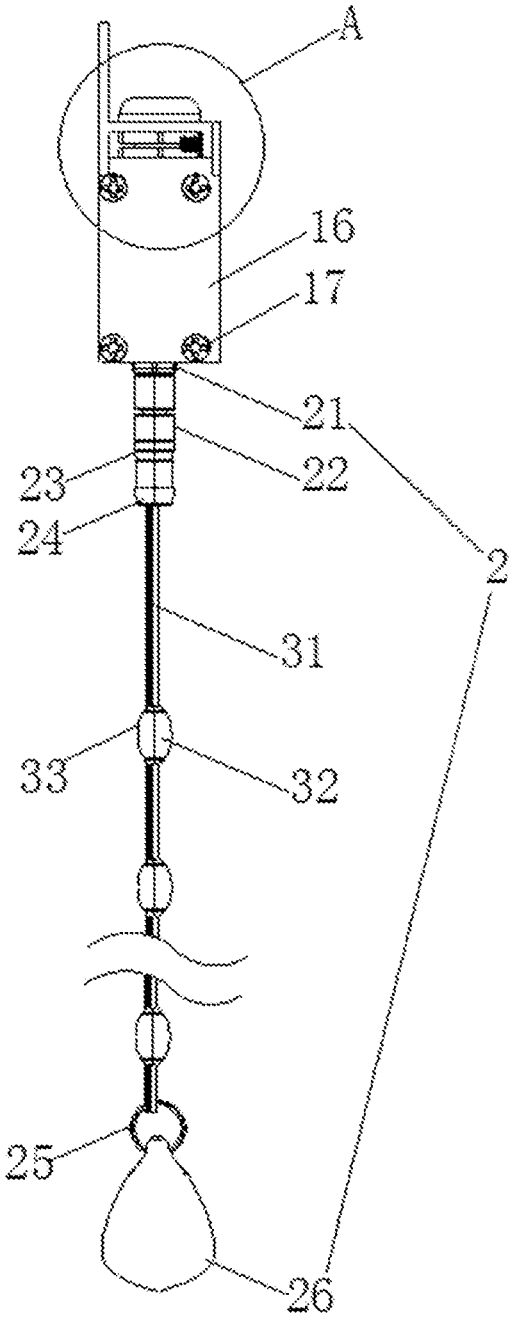
FIG. 2 is a side schematic diagram of the smart curtain light strings of the present disclosure.
Figure 3:
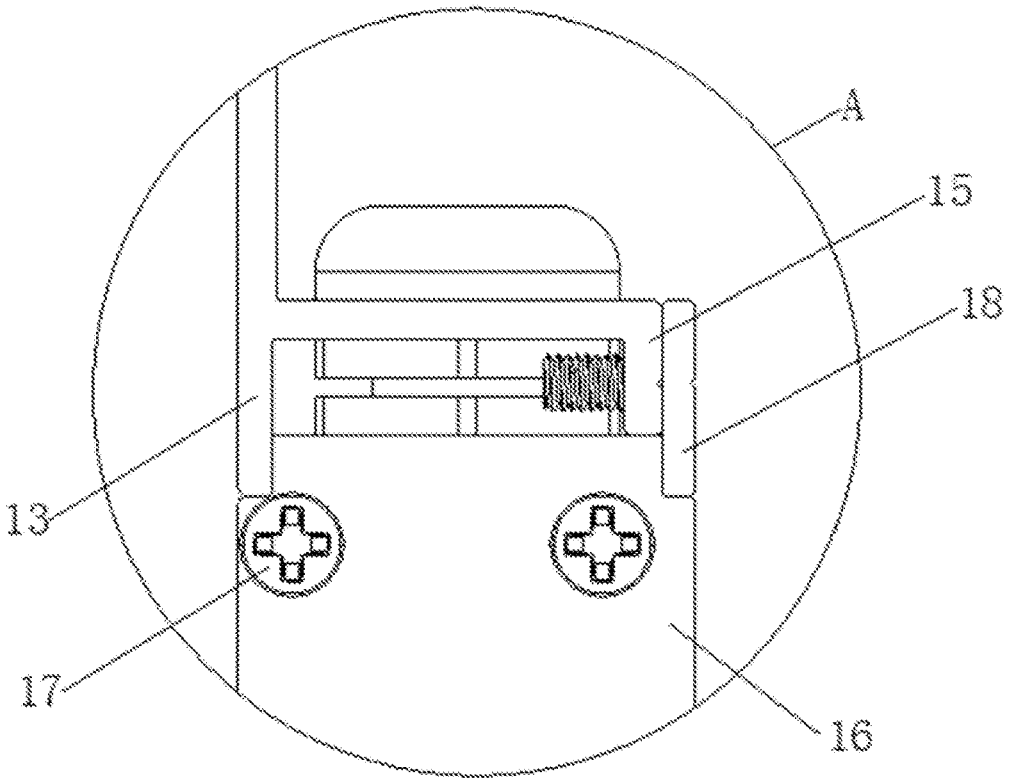
FIG. 3 is an enlarged view of portion A shown in FIG. 2.
Figure 4:
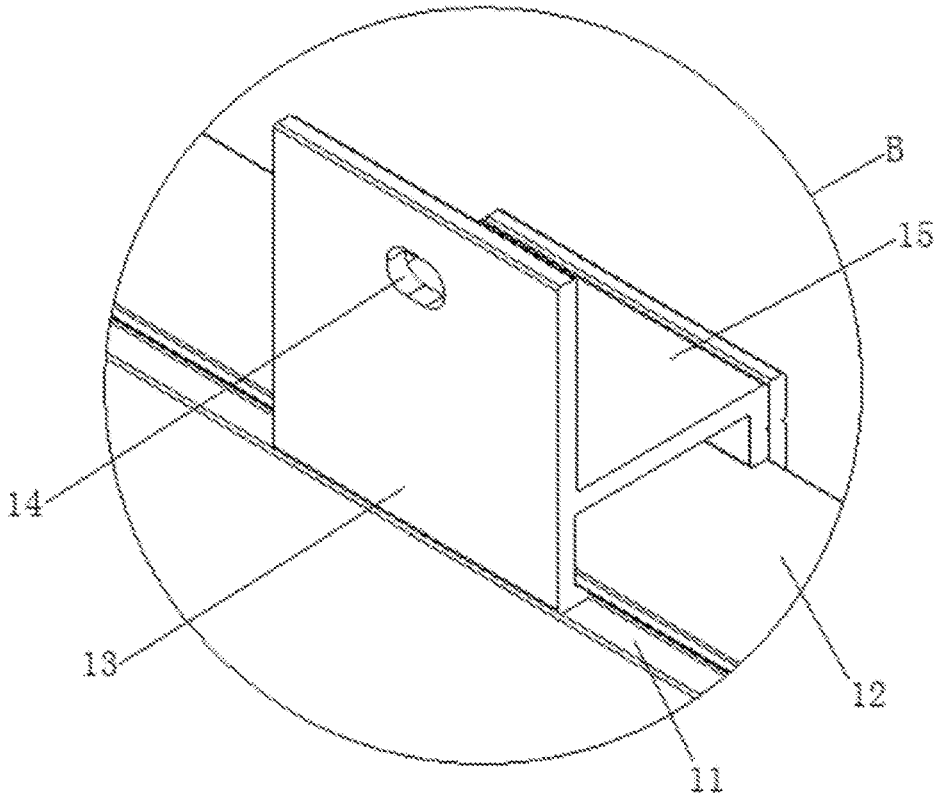
FIG. 4 is an enlarged view of portion B shown in FIG. 1.
Figure 5:
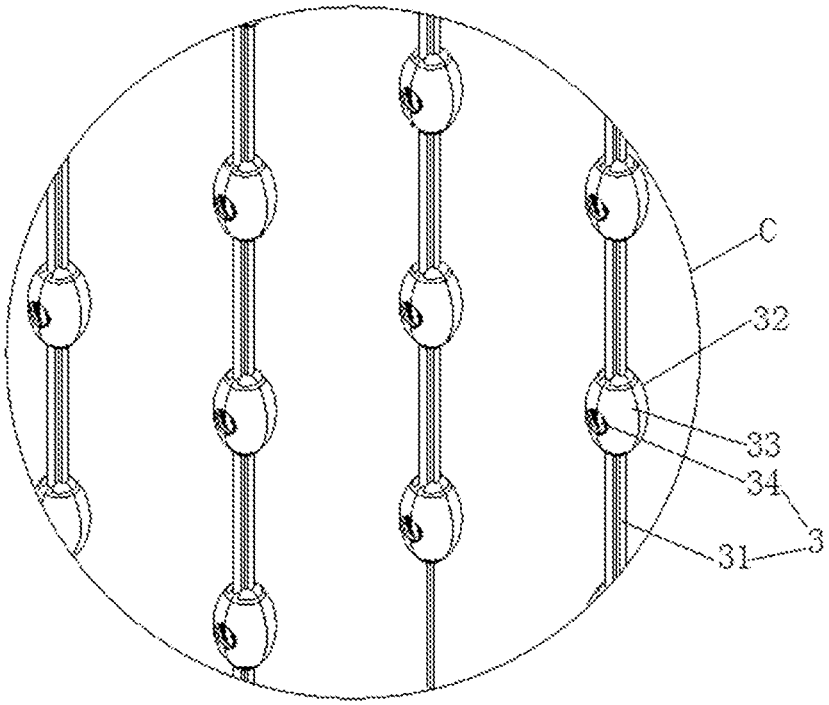
FIG. 5 is an enlarged view of portion C shown in FIG. 1.
Figure 6:
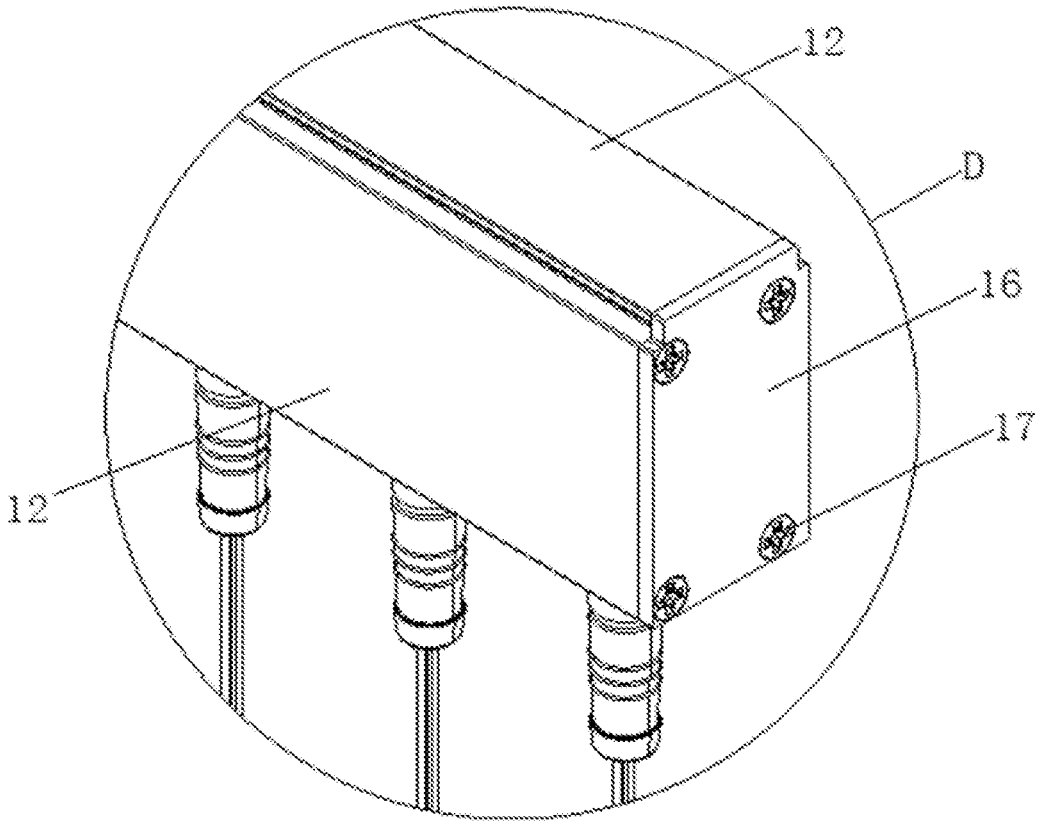
FIG. 6 is an enlarged view of portion D shown in FIG. 1.
Figure 7:
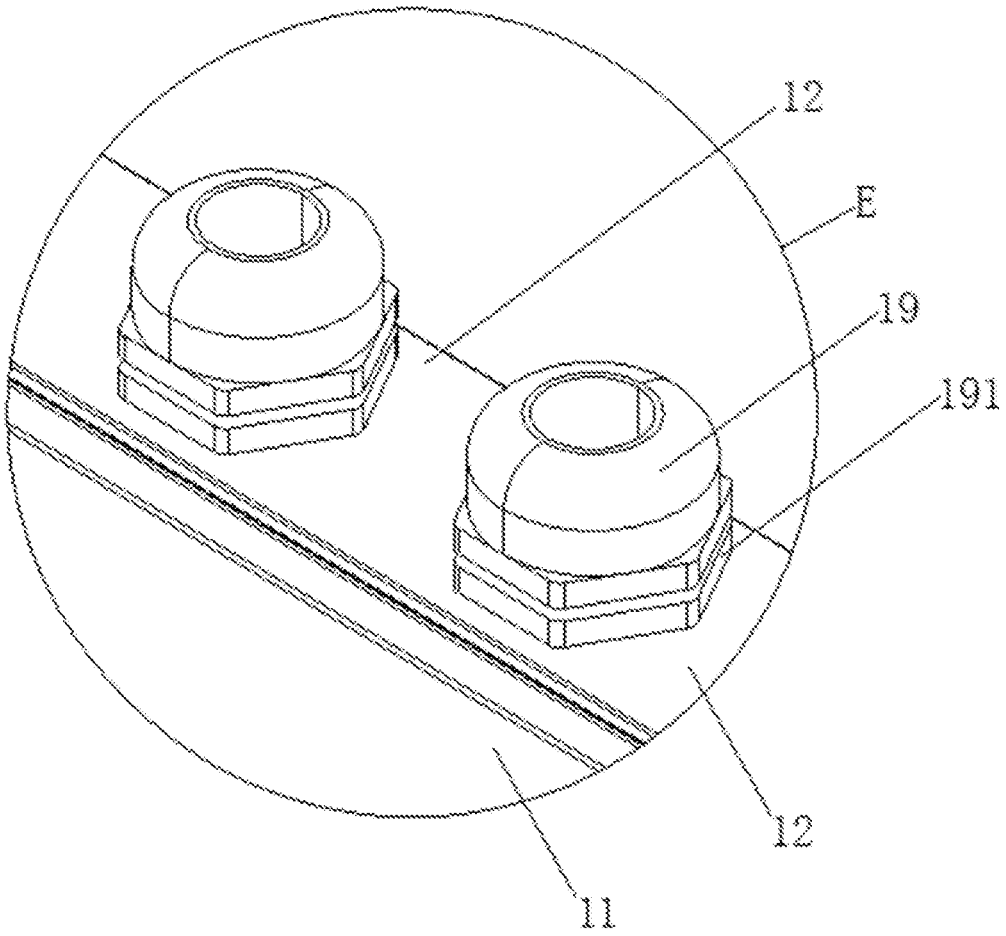
FIG. 7 is an enlarged view of portion E shown in FIG. 1.
Figure 8:
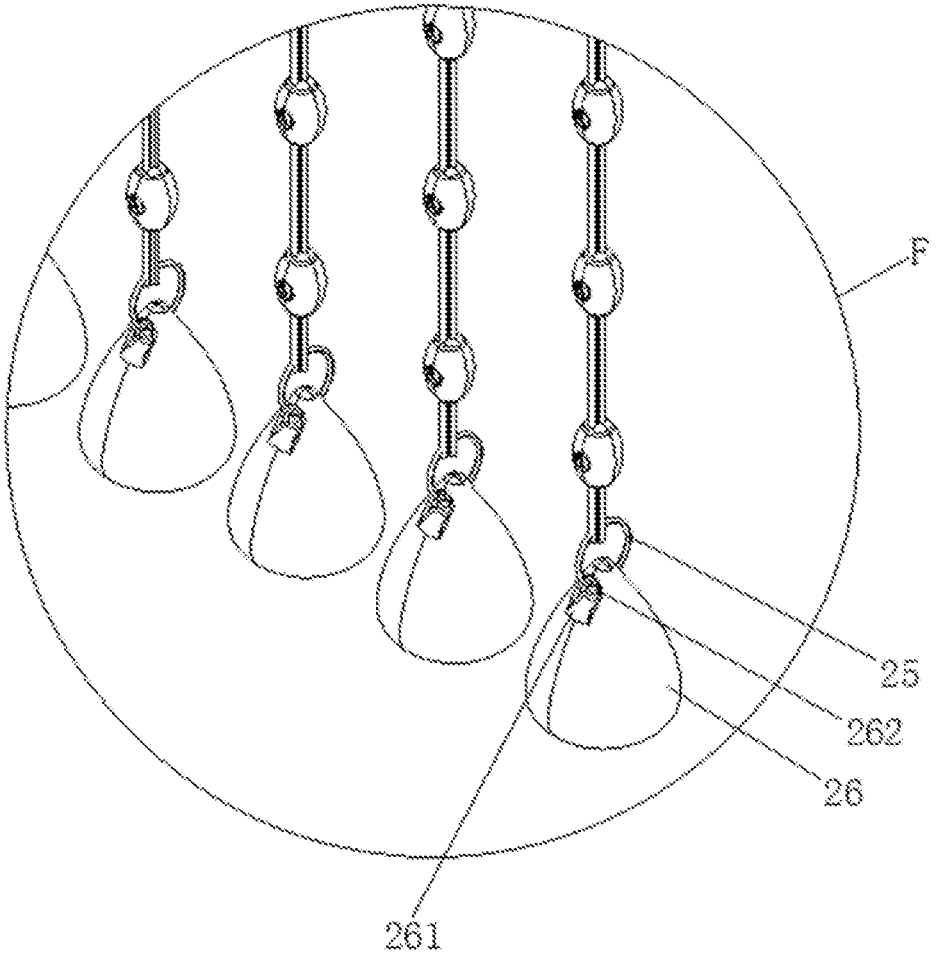
FIG. 8 is an enlarged view of portion F shown in FIG. 1.
Figure 9:
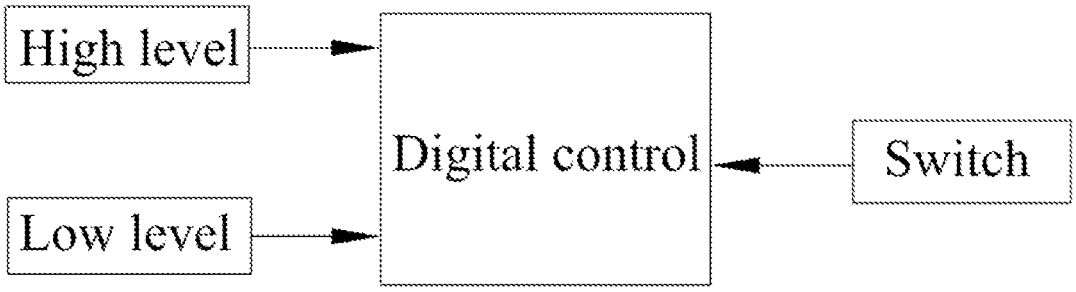
FIG. 9 is a block diagram of a lamp bead circuit of the present disclosure.
Figure 10:
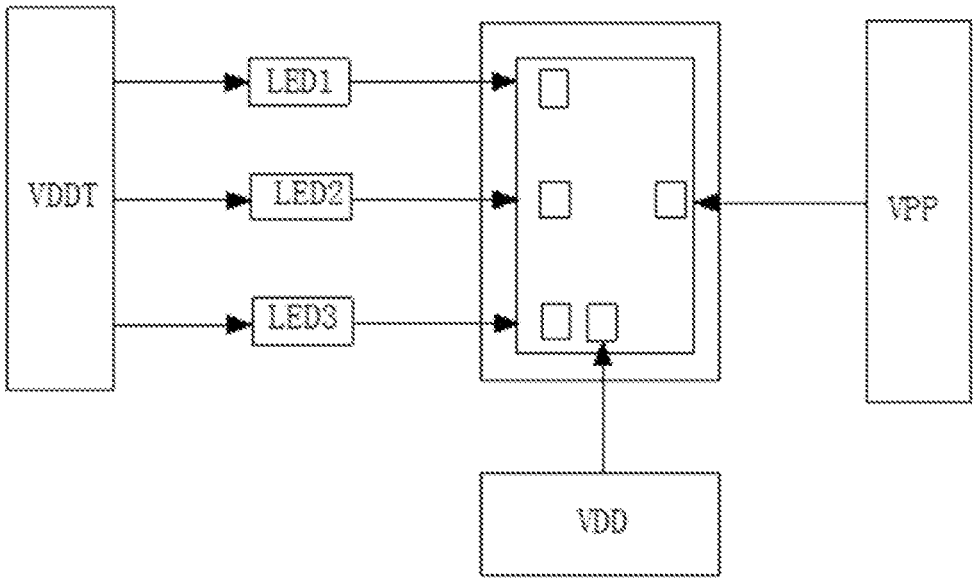
FIG. 10 is a schematic diagram of a power supply module of the present disclosure.

As shown in FIGS. 1-10, the present disclosure provides smart curtain light strings. The smart curtain light strings comprises a fixing unit 1, a mounting unit 2, a light-emitting unit 3, and a control unit 4. The fixing unit 1 passes through the mounting unit 2. The fixing unit 1 is engaged with the mounting unit 2. The fixing unit 1 comprises a first guiding rail 11 and a second guiding rail 12. Fixing pieces 13 are fixedly connected with a top portion of the second guiding rail 12 by screws. A horizontal plate 15 is fixedly connected to a side of each fixing piece 13. Fixing plates 16 are mounted on two sides of the first guiding rail 11. Positioning pieces 19 are threadedly connected to the top portion of the second guiding rail 12. The mounting unit 2 comprises clamping sleeves 21 and clump weights 26. A stabilizing sleeve 22 passes through an interior of each clamping sleeve 21. Each stabilizing sleeve 22 is screwed with each clamping sleeve 21 through threads on an inner surface of each clamping sleeve 21. A package cap 24 is connected to a bottom portion of each stabilizing sleeve 22 through threads. A groove 261 is disposed on a surface of each clump weight 26. A connecting hole 262 is on each groove 261. A hanging ring 25 passes through an interior of each connecting hole 262. The light-emitting unit 3 comprises electrical wires 31 and LED lamp beads 34. Outer surfaces of the electrical wires 31 are electrically connected to the LED lamp beads 34, A first protective shell 32 and a second protective shell 33 are mounted on an outer surface of each LED lamp bead 34, Each first protective shell 32 is glued and connected with a corresponding second protective shell 33. The control unit 4 comprises a lamp bead circuit, a digital control chip, and a switch. The digital control chip is an STM32F030F4P6 microprocessor. A signal transmission end of the STM32F030F4P6 ARM microprocessor and a signal input end of the switch are connected with each other. A power signal input end of the STM32F030F4P6 ARM microprocessor is connected with a high level. A ground terminal of the STM32F030F4P6 ARM microprocessor is connected with a low level.

In another embodiment, a limit groove is formed between the first guiding rail 11 and the second guiding rail 12. Each fixing piece 13 is arranged in an L shape. A bottom portion of each fixing piece 13 fully contacts a top surface of the first guiding rail 11. A fixing hole 14 is on one side of each fixing piece 13. An opening of each fixing hole 14 is oblong. In the present disclosure, each fixing piece 13 fully, contacts the first guiding rail 11 and the second guiding rail 12, so that each fixing piece is slidable along an edge of the first guiding rail, which facilitates an adjustment of a mounting position of each fixing piece 13.

In another embodiment, the fixing plates 16 are respectively mounted on both ends of the first guiding rail 11. One side of each fixing plate 16 is threadedly connected with two locking pieces 17. The fixing plates 16 are respectively mounted on both ends of the first guiding rail 11, so that an end portion of the first guiding rail 11 is connected with an end portion of the second guiding rail 12, which enhances stability of the connection between the first guiding rail 11 and the second guiding rail 12.

In another embodiment, one end of each horizontal plate 15 is connected with a respective integration block 18. A threaded locking rod is disposed in the integration block 18. A bottom portion of each integration block 18 matches and clamps with the second guiding rail 12. Each integration block 18 is fixedly connected with one end of each horizontal plate 15. A side surface of each fixing plate 16 is integrated and fixed by the integration block 18. A contact surface between each integration block 18 and each horizontal plate 15 is flat, so the a mounting position of each horizontal plate 15 is limited by each integration block 18, which improves installation accuracy of the horizontal plates 15.

In another embodiment, a gasket 191 is sleeved on a surface of each positioning piece 19. A circular groove is disposed on a top portion of the positioning piece 19, and each gasket 191 is a hexagonal metal sheet. By setting two hexagonal metal gaskets 191, fixing force of the connection between the positioning pieces 19 and the second guiding rail 12 is improved by the two gasket 191. Meanwhile, the gaskets 191 buffer friction between the positioning pieces 19 and the second guiding rail 12, which prevent the positioning pieces 19 from being loosen during use, increase a service life of the positioning pieces 19, and improves reliability of the installation of the smart curtain light strings.

In another embodiment, an anti-skid ring 23 is disposed on an outer surface of each stabilizing sleeve 22. Each anti-skid ring 23 is an annular protrusion. Each clamping sleeve 21 is arranged concentrically with a corresponding stabilizing sleeve 22 and a corresponding package cap 24, Each clump weight 26 is a drop-shaped clump weight. By providing the anti-skid rings 23, an anti-skid performance of the stabilizing sleeves 22 during an installation process is improved. By providing the package caps 24, a connecting portion between each electrical wire 31 and each package cap 24 is limited, so shake amplitudes of the electrical wires would not be too large when the electrical wires are shaken by an external force. Meanwhile, each clamping sleeve 21, each stabilizing sleeve 22, and each package cap 24 are connected through threads to guide one end of each electrical wire 31, so a top end of each electrical wire 31 is disposed along a vertical direction. Further, by cooperation between each clamping sleeve 21, each stabilizing sleeve 22, and each package cap 24, the outer surface of each electrical wire 31 is protected, which prolongs a service life of the electrical wires 31.

In another embodiment, a bottom portion of each electrical wire 31 is movably connected with a corresponding clump weight 26 via a corresponding hanging ring 25. The electrical wires 31 are linearly arranged at equal intervals. An outer surface of each electrical wire 31 are fixedly connected with a plurality of the LEI) lamp beads 34. By providing the clump weights 26, the electrical wires 31 care kept in a hanging state, thereby facilitating layout and mounting of the LED lamp beads 34, Compared with the conventional light strings, by providing the curtain-type electrical wires 31 and the LED lamp beads 34, an area of a decorative surface of the smart curtain light strings and the coverage area of the decorative surface are increased, thereby forming a strong visual impact and visual effect.

In another embodiment, the high level ranges from 3.5-5V and the low level ranges from 0-0.25V.

In another embodiment, the lamp bead circuit comprises a component supply voltage VDDT, a device supply voltage VDD, and a peak-to-peak voltage VPP. The component supply voltage VDDT supplies power to the LED lamp beads 34. The device supply voltage VDD supplies power to the digital control chip. The peak-to-peak voltage VPP is configured to write code and burn the codes.

A working principle of the present disclosure is as follow:

When in use, by connecting the first guiding rail 11 with the second guiding rail 12, a limit groove matching and connecting to the bottom portion of each fixing piece 13 is formed at the connecting portion of the first guiding rail 11 and the second guiding rail 12. The limit groove limits a sliding direction and trajectory of each fixing piece 13. After adjusting the mounting position of the fixing pieces 13, the fixing unit 1 is fixedly mounted through cooperation of the fixing holes 14. By setting the metal gaskets 191, the fixing force between the positioning pieces 19 and the second guiding rail 12 is improved. Meanwhile, the gaskets 191 buffer the friction between the positioning pieces 19 and the second guiding rail 12, which prevent the positioning pieces 19 from being loosen during threaded connection. The top portions of each clamping sleeve 21 passes through and connected with the bottom portion of the first guiding rail 11. Moreover, each electrical wire 31 passes through the interior of each clamping sleeve 21, and the top portion of each electrical wires 31 is limited by the cooperation of the corresponding clamping sleeve 21 with the stabilizing sleeve 22 and the package cap 24 to ensure that each electrical wires 31 is in a vertical state. The electrical wire 31 are connected to the LED lamp beads 34. The STM32F030F4P6 ARM microprocessor is used as the digital control chip. A voltage pin of the STM32F030F4P6 ARM microprocessor is electrically connected to an external power supply. After the switch is turned on, the component supply voltage VDDT supplies power to the LED lamp beads 34, the device supply voltage VIM) supplies power to the STM32F030F4P6 ARM microprocessor, and the peak-to-peak voltage VPP writes the codes and burns the codes, so that the LED lamp beads 34 are lit. The smart curtain light strings are used to decorate outdoor lawns or parks and other buildings. The smart curtain light strings forms a block embellishment effect and greatly improves the scalability of the light strings.

In the present disclosure, unless otherwise expressly stated and defined, a first feature is disposed "upper" or "lower" a second feature means that the first feature may direct contact the second feature or the first features are connected with the second feature through other features. Moreover, the first feature disposed "above", "over" or "on" the second feature means that the first feature may disposed directly above or obliquely above the second feature, or only means that a level of the first feature is higher than that of the second feature. The first feature is disposed "beneath", "below" and "under" the second feature means that the first feature is directly below or obliquely below the second feature, or only means that the level of the first feature level is less than that of the second feature.

Basic principles, main features, and advantages of the present disclosure are shown and described above. Those skilled in the field will be appreciated that the present disclosure is not limited by the above-described embodiments. The optional embodiments of the present disclosure are not intended to limit the scope of the present disclosure, and various changes and modifications that made without departing from the spirit and scope of the present disclosure should all fall within the scope of the present disclosure.

What is claimed is:

1. Smart curtain light strings, comprising:

a fixing unit (1);

a mounting unit (2);

a light-emitting unit (3); and a control unit (4), wherein the fixing unit (1) passes through the mounting unit (2); the fixing unit (1) is engaged with the mounting unit (2); the fixing unit (1) comprises a first guiding rail (11) and a second guiding rail (12); fixing pieces (13) are fixedly connected with a top portion of the second guiding rail (12) by screws; a horizontal plate (15) is fixedly connected to a side of each fixing piece (13); fixing plates (16) are mounted on two sides of the first guiding rail (11); positioning pieces (19) are connected to the top portion of the second guiding rail (12);

the mounting unit (2) comprises clamping sleeves (21) and clump weights (26); a stabilizing sleeve (22) passes through an interior of each clamping sleeve (21); each stabilizing sleeve (22) is screwed with each clamping sleeve (21 through threads on an inner surface of each clamping sleeve (21); a package cap (24) is connected to a bottom portion of each stabilizing sleeve (22) through threads; a groove (261) is disposed on a surface of each clump weight (26); a connecting hole (262) is on each groove (261); a hanging ring (25) passes through an interior of each connecting hole (262);

wherein the light-emitting unit (3) comprises electrical wires (31) and LED lamp beads (34); outer surfaces of the electrical wires (31) are electrically connected to the LED lamp beads (34); a first protective shell (32) and a second protective shell (33) are mounted on an outer surface of each LED lamp bead (34); each first protective shell (32) is glued and connected with a corresponding second protective shell (33);

wherein the control unit (4) comprises a lamp bead circuit, a digital control chip, and a switch; the digital control chip is an STM32F030F4P6 ARM microprocessor; a signal transmission end of the STM32F030F4P6 ARM microprocessor and a signal input end of the switch are connected with each other; a power signal input end of the STM32F030F4P6 ARM microprocessor is connected with a high level; a ground terminal of the STM32F030F4P6 ARM microprocessor is connected with a low level.

2. The smart curtain light strings according to claim 1, wherein a limit groove is formed between the first guiding rail (11) and the second guiding rail (12); each fixing piece (13) is arranged in an L shape, a bottom portion of each fixing piece (13) fully contacts a top surface of the first guiding rail (11); a fixing hole (14) is on one side of each fixing piece (13); an opening of each fixing hole (14) is oblong.

3. The smart curtain light strings according to claim 1, wherein the fixing plates (16) are respectively mounted on both ends of the first guiding rail (11); one side of each fixing plate (16) is threadedly connected with two locking pieces (17).

4. The smart curtain light strings according to claim 1, wherein one end of each horizontal plate (15) is connected with a respective integration block (18); a threaded locking rod is disposed in the integration block (18); a bottom portion of each integration block (18) matches and clamps with the second guiding rail (12).

5. The smart curtain light strings according to claim 1, wherein a gasket (191) is sleeved on a surface of each positioning piece (19), a circular groove is disposed on a top portion of the positioning piece (19), and each gasket (191) is a hexagonal metal sheet.

6. The smart curtain light strings according to claim 1, wherein an anti-skid ring (23) is disposed on an outer surface of each stabilizing sleeve (22); each anti-skid ring (23) is an annular protrusion, each clamping sleeve (21) is arranged concentrically with a corresponding stabilizing sleeve (22) and a corresponding package cap (24); each clump weight (26) is a drop-shaped clump weight.

7. The smart curtain light strings according to claim 1, wherein a bottom portion of each electrical wire (31) is movably connected with a corresponding clump weight (26) via a corresponding hanging ring (25); the electrical wires (31) are linearly arranged at equal intervals; an outer surface of each electrical wire (31) are fixedly connected with a plurality of the LED lamp beads (34).

8. The smart curtain light strings according to claim 1, wherein: the high level ranges from 3.5-5V, and the low level ranges from 0-0.25V.

9. The smart curtain light strings according to claim 1, wherein: the lamp bead circuit comprises a component supply voltage (VDDT), a device supply voltage (VDD), and a peak-to-peak voltage (VPP); the component supply voltage (VDDT) supplies power to the LED lamp beads (34), the device supply voltage (VDD) supplies power to the digital control chip; the peak-to-peak voltage (VPP) is configured to write code and burn the codes.

* * * * *